US005371805A

United States Patent [19]

Saiki et al.

[11] Patent Number: 5,371,805

[45] Date of Patent: Dec. 6, 1994

[54] SPEAKER AND SPEAKER SYSTEM EMPLOYING THE SAME

[75] Inventors: Shuji Saiki, Nara; Kazuki Honda, Katano; Satoshi Koura, Neyagawa, all of Japan

[73] Assignee: Matsushita Electric Industrial Co., Ltd., Osaka, Japan

[21] Appl. No.: 19,684

[22] Filed: Feb. 19, 1993

[30] Foreign Application Priority Data

Feb. 21, 1992 [JP] Japan ..... 4-34662
Mar. 11, 1992 [JP] Japan ..... 4-52550
Apr. 15, 1992 [JP] Japan ..... 4-95059

[51] Int. Cl.[5] ..... H04R 25/00; G10K 13/00

[52] U.S. Cl. ..... 381/192; 381/193; 381/202; 381/203; 381/204; 181/171; 181/172; 181/173

[58] Field of Search ..... 381/192, 193, 202, 204; 181/171, 172

[56] References Cited

U.S. PATENT DOCUMENTS 1,732,351 10/1929 Borkman ..... 181/173
1,930,328 10/1933 Tichenor et al. ..... 181/172
4,122,314 10/1978 Matsuda et al. ..... 181/172
4,228,327 10/1980 Sawafuji ..... 381/193
4,639,283 1/1987 Nakamura .
4,699,242 10/1987 Ono .

FOREIGN PATENT DOCUMENTS 0087177 8/1983 European Pat. Off. .
57-9196 1/1982 Japan .
60-43095 3/1985 Japan .
0666494 2/1952 United Kingdom ..... 381/92
2055528 3/1981 United Kingdom ..... 381/193

*Primary Examiner*—Curtis Kuntz
*Assistant Examiner*—Sinh Tran
*Attorney, Agent, or Firm*—Wenderoth, Lind & Ponack

[57] ABSTRACT

A speaker has an edge member which includes a plurality of peripheral pieces and a plurality of connecting portions for connecting neighboring ones of the pieces. The neighboring ones of the pieces have cross-sectional shapes symmetric with respect to each other in an axial direction of the edge member. Each of the connecting portions has a cross-sectional shape that changes gradually and continuously. A diaphragm which is secured to an inner periphery or an outer periphery of the edge member, and a frame is secured to an outer periphery or an inner periphery of the edge member.

11 Claims, 16 Drawing Sheets

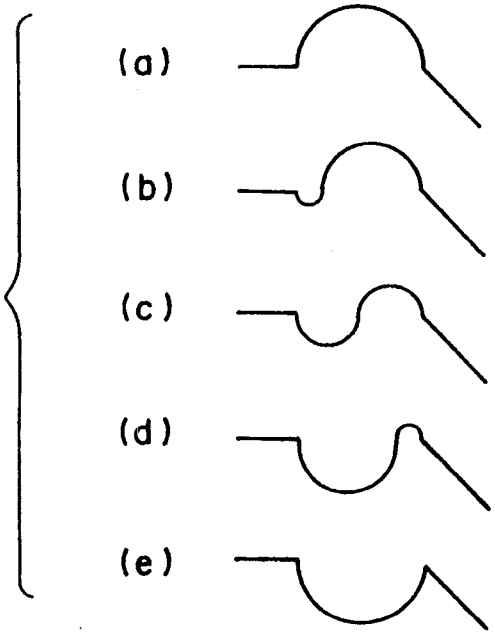
Fig. 5
(K1)
Fig. 4
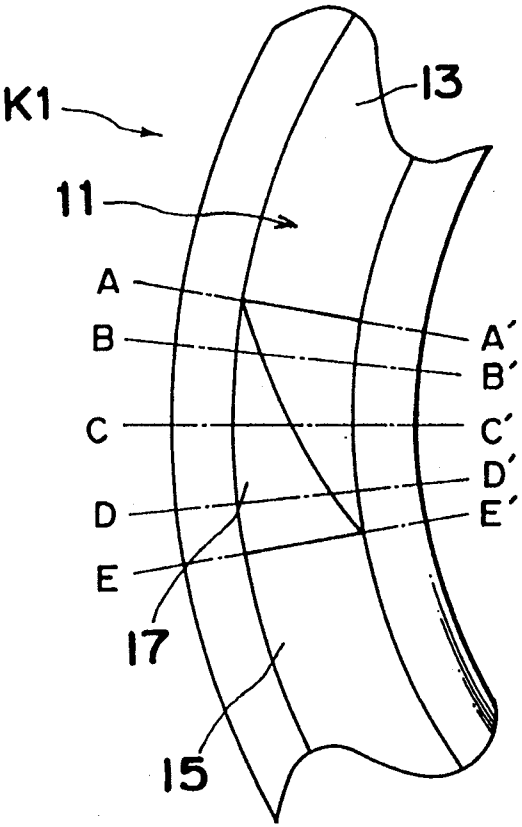

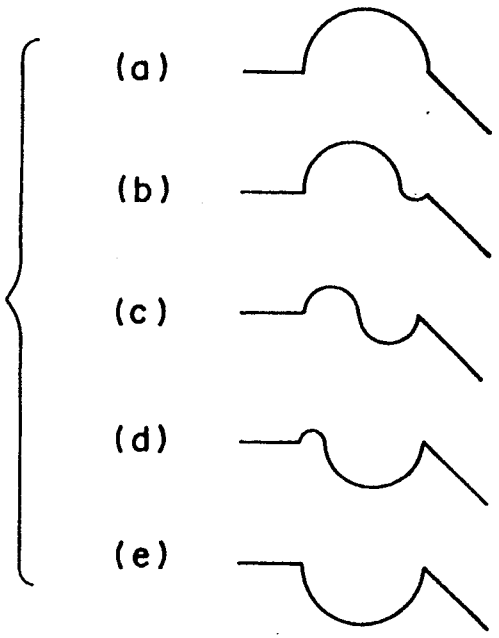
Fig. 7
(K2)
Fig. 6
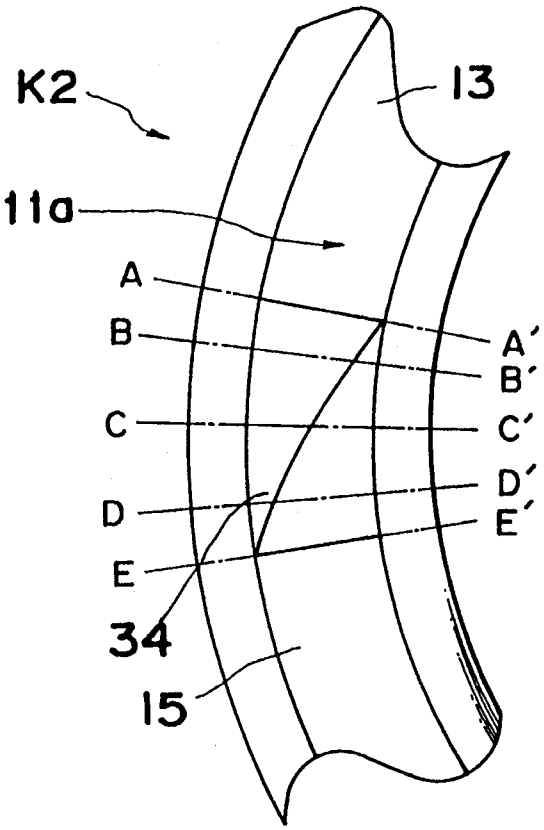

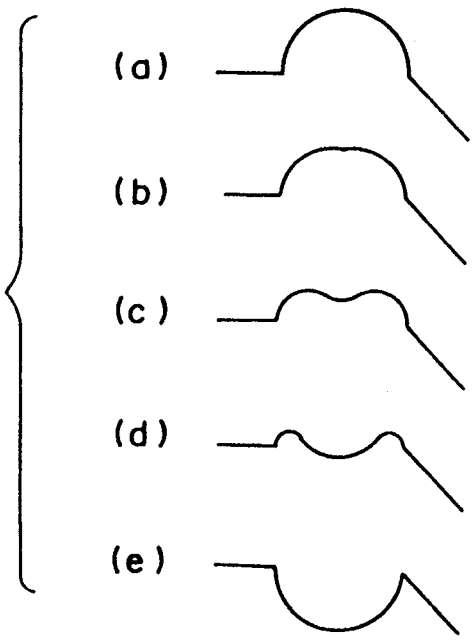
Fig. 11
(K3)
Fig. 10
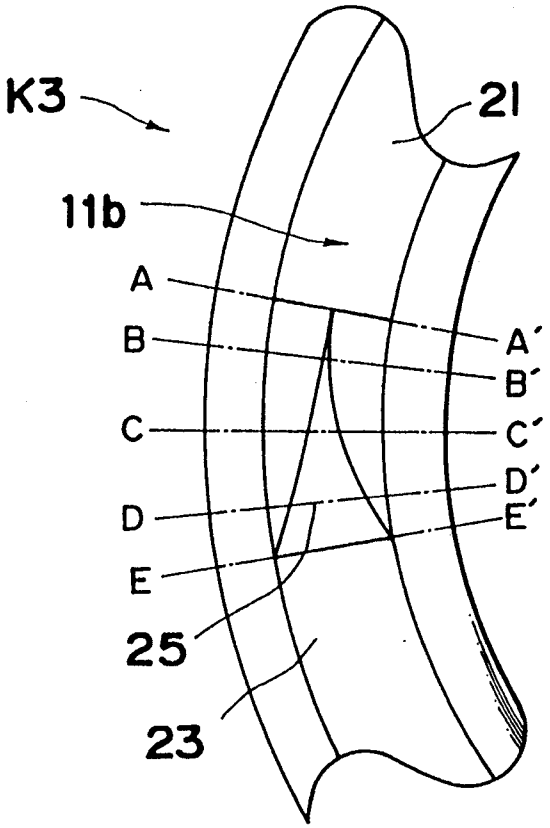

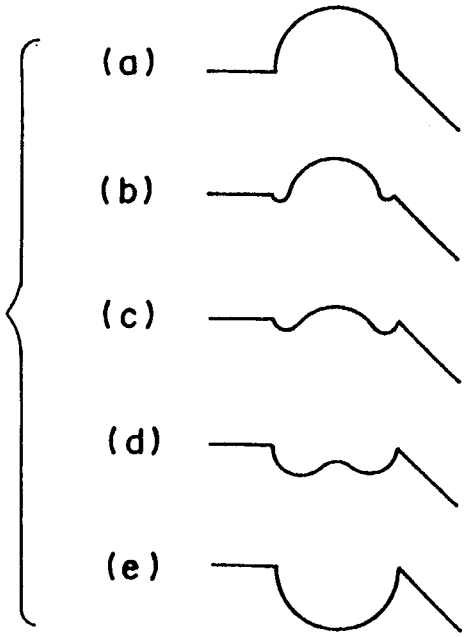
Fig. 13
(K4)
Fig. 12
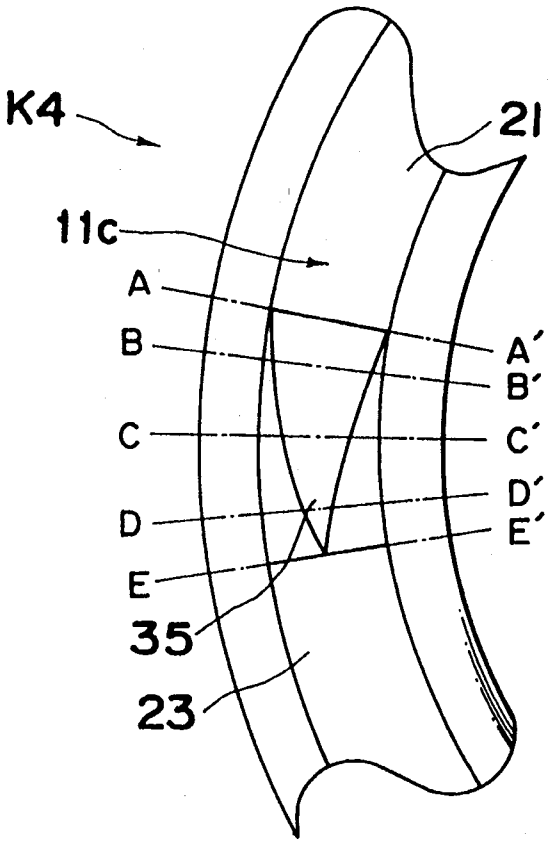

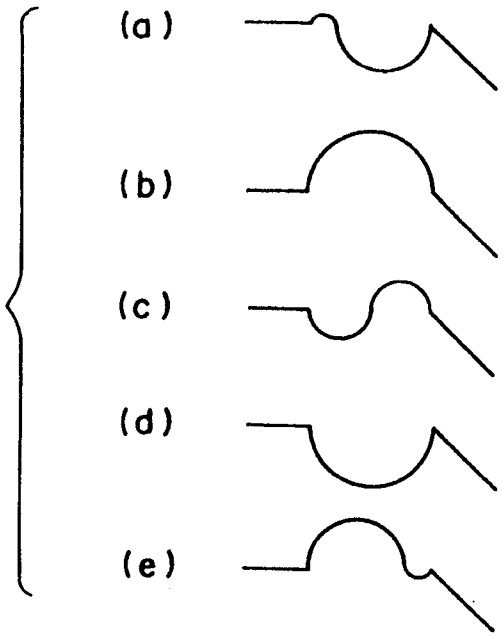
Fig. 15
(K5)
Fig. 14
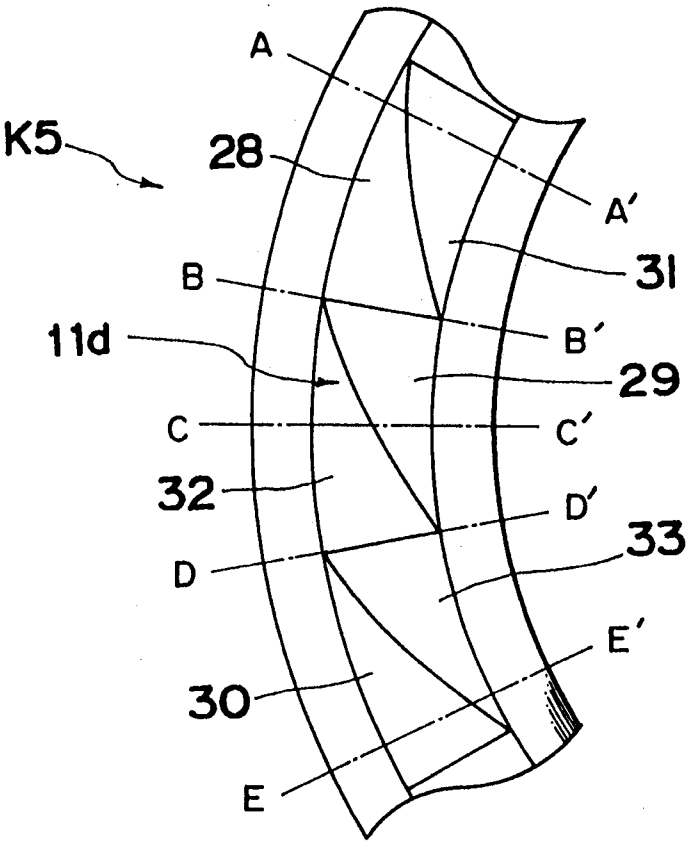

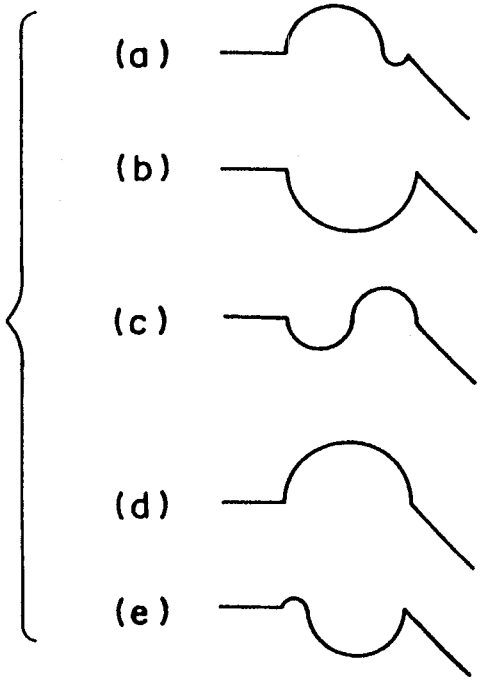
Fig. 17
(K6)
Fig. 16
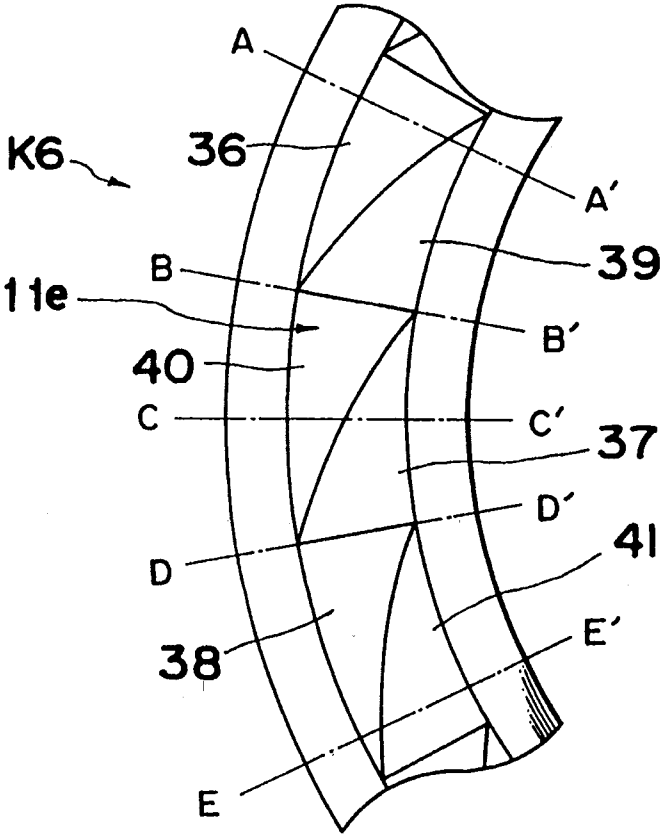

SPEAKER AND SPEAKER SYSTEM EMPLOYING THE SAME

BACKGROUND OF THE INVENTION

The present invention relates to a speaker and a speaker system employing a plurality of the speakers.

In a known speaker, a cone-shaped diaphragm is attached to a distal end of a voice coil bobbin and a damper is fixed to an outer periphery of the voice coil bobbin. An edge member is provided at an outer peripheral portion of the cone-shaped diaphragm, while a voice coil is held in a magnetic gap of a magnetic circuit.

In the known speaker of the above described arrangement, when an electrical signal is applied to the voice coil, a driving force produced in the voice coil is transmitted to the voice coil bobbin so as to vibrate the cone-shaped diaphragm secured to the distal end of the voice coil bobbin. The cone-shaped diaphragm is supported by the damper fixed to the outer periphery of the voice coil bobbin and the edge member. Linearity of a supporting force of the damper and the edge member, which support the cone-shaped diaphragm poses a problem, especially when reproducing in a low-pitched zone, and forms a main cause of the production of harmonic distortion.

In order to improve the linearity of the supporting force of the support members, various shapes have been proposed. As a result, an edge member which is formed into a rolled shape having a semicircular cross section is most popularly used at present. By combining this edge member with a damper having a corrugated cross section, linearity of the supporting force of the support members has been improved substantially. FIG. 25 shows vibration states of the rolled edge member. In FIG. 25, reference numeral 7 denotes the cone-shaped diaphragm, reference numeral 9 denotes the rolled edge member and reference numeral 10 denotes a frame to which an outer periphery of the edge member 9 is secured. In FIG. 25, character A represents a neutral vibration state prior to application of the electrical signal to the voice coil, in which the rolled edge member 9 is disposed at a neutral point, character B represents a forward vibration state in which the rolled edge member 9 is forwardly vibrated through an amplitude I from the neutral point and character C represents a rearward vibration state in which the rolled edge member 9 is rearwardly vibrated through the amplitude I from the neutral point. Since the rolled edge member 9 is vibrated through the amplitude I forwardly and rearwardly from the neutral point in the forward and rearward vibration states B and C, respectively, as described above, the motion of the edge member 9, acting as the support member for the cone-shaped diaphragm 7, does not include a non-linear component.

In FIG. 25, when the rolled edge member 9 is vibrated from the neutral vibration state A to the forward vibration state B, the edge member 9, vibrating together with the cone-shaped diaphragm 7, displaces a quantity U1 of air. Meanwhile, when the rolled edge member 9 is vibrated from the neutral vibration state A to the rearward vibration state C, the rolled edge member 9 displaces a quantity U2 of air. Since the rolled shape of the rolled edge member 9 is deformed between the forward and rearward vibration states B and C, the quantities U1 and U2 of air become different from each other.

Sound pressure characteristics of the speaker are proportional to a sum of a quantity of air displaced by the cone-shaped diaphragm 7 and a quantity of air displaced by the edge member 9. However, in the known speaker, since the quantities U1 and U2 of air displaced by the edge member 9 in the forward and rearward vibrations become different from each other, as described above, secondary harmonic distortion is likely to be generated when reproducing in the low-pitched zone.

SUMMARY OF THE INVENTION

Accordingly, an essential object of the present invention is to provide a speaker including an edge member for supporting a diaphragm, in which is greatly reduced, without deterioration, the linearity of a supporting force of the edge member.

In order to accomplish this object of the present invention, a speaker embodying the present invention comprises an edge member which includes a plurality of peripheral pieces and a plurality of connecting portions for connecting neighboring ones of the pieces. The neighboring ones of the pieces have cross-sectional shapes symmetric with respect to each other in an axial direction of the edge member, while each of the connecting portions has a cross-sectional shape changing gradually and continuously. A diaphragm is secured to an inner periphery or an outer periphery of the edge member, and a frame is secured to an outer periphery or an inner periphery of the edge member.

By the above described arrangement of the speaker of the present invention, when the diaphragm is vibrated forwardly and rearwardly, the sum of quantities of air displaced by the neighboring pieces is set to a predetermined value.

Therefore, in accordance with the present invention, secondary harmonic distortion of sound pressure characteristics, which is caused by the difference between quantities of air displaced by the edge member in the forward and rearward vibrations of the diaphragm, can be greatly reduced.

BRIEF DESCRIPTION OF THE DRAWINGS

The above and further objects and features of the present invention will become apparent from the following description, taken in conjunction with preferred embodiments thereof, and with reference to the accompanying drawings, in which:

FIG. 4 is a top plan view of the connecting portion of the edge member of FIG. 3;

FIG. 5 shows views (a), (b), (c), (d) and (e), which are sectional views taken along lines A–A′, B–B′, C–C′, D–D′ and E–E′ in FIG. 4, respectively;

FIG. 6 is a top plan view of a connecting portion of an edge member in a speaker according to a second embodiment of the present invention;

FIG. 7 shows views (a), (b), (c), (d) and (e), which are sectional views taken along lines A–A′, B–B′, C–C′, D–D′ and E–E′ in FIG. 6, respectively;

FIG. 10 is a top plan view of a connecting portion of an edge member in the speaker of FIG. 8;

FIG. 11 shows views (a), (b), (c), (d) and (e), which are sectional views taken along lines A–A', B–B', C–C', D–D' and E–E' in FIG. 10, respectively;

FIG. 12 is a top plan view of a connecting portion of an edge member in a speaker according to a fourth embodiment of the present invention;

FIG. 13 shows views (a), (b), (c), (d) and (e), which are sectional views taken along lines A–A', B–B', C–C', D–D' and E–E' in FIG. 12, respectively;

FIG. 14 is a top plan view of a connecting portion of an edge member in a speaker according to a fifth embodiment of the present invention;

FIG. 15 shows views (a), (b), (c), (d) and (e), which are sectional views taken along lines A–A', B–B', C–C', D–D' and E–E' in FIG. 14, respectively;

FIG. 16 is a top plan view of a connecting portion of an edge member in a speaker according to a sixth embodiment of the present invention;

FIG. 17 shows views (a), (b), (c), (d) and (e), which are sectional views taken along lines A–A', B–B', C–C', D–D' and E–E' in FIG. 16, respectively;

Before the description of the present invention proceeds, it is to be noted that like parts are designated by like reference numerals throughout several views of the accompanying drawings.

DETAILED DESCRIPTION OF THE INVENTION

Figure 1:
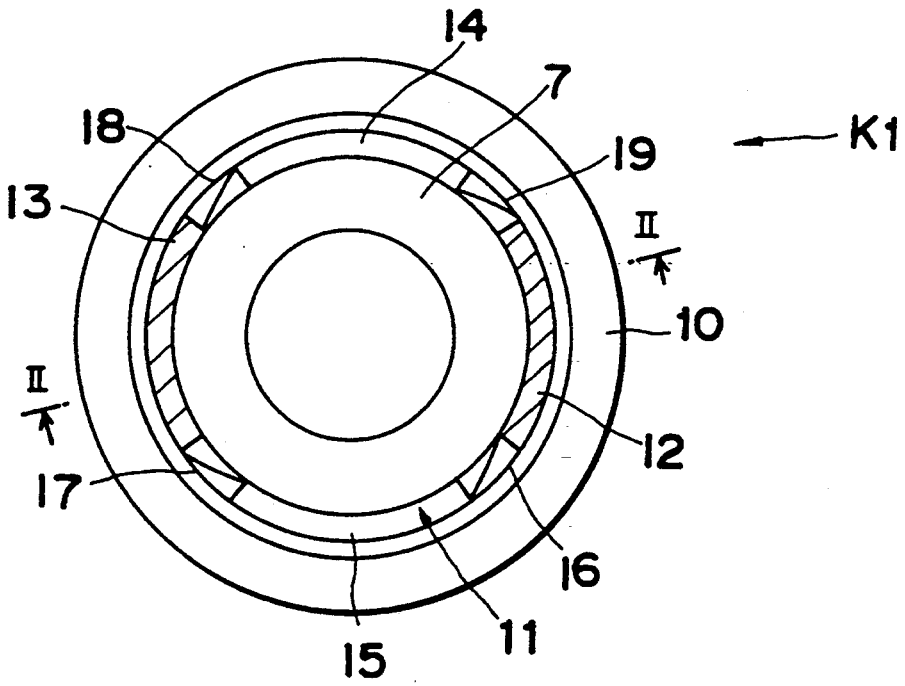
FIG. 1 is a top plan view of a speaker according to a first embodiment of the present invention.
Figure 2:
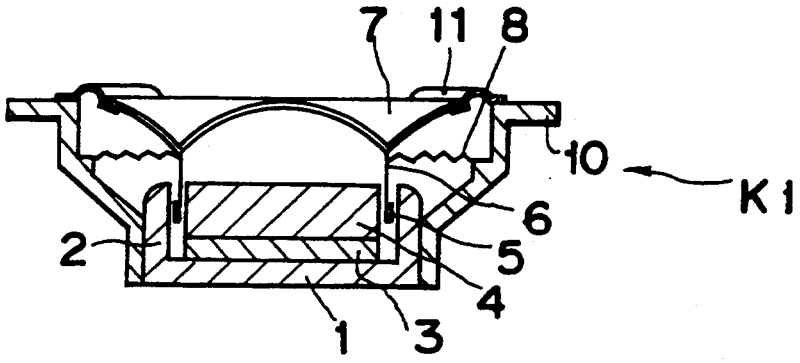
FIG. 2 is a sectional view taken along a line II—II in FIG. 1.

Referring now to the drawings, there is shown in FIGS. 1 to 5 a speaker K1 according to a first embodiment of the present invention. The speaker K1 includes a plate 1, a yoke 2 formed integrally with the plate 1, a magnet 3 fixed to the plate 1, a center pole 4 secured to an upper face of the magnet 3, a voice coil 5 held in a magnetic gap defined between an outer periphery of the center pole 4 and an inner periphery of the yoke 2, a bobbin 6 for the voice coil 5, a cone-shaped diaphragm 7 attached to a distal end of the bobbin 6, an annular edge member 11 provided at an outer peripheral portion of the diaphragm 7 and a frame 10. Outer peripheral portions of a damper 8 and the edge member 11 are fixed to the frame 10. A magnetic circuit constituted by the plate 1, the yoke 2, the magnet 3 and the center pole 4 is retained by the frame 10.

The edge member 11 is circumferentially divided into four pieces, namely, a convexly rolled piece 12, a concavely rolled piece 14, a convexly rolled piece 13 and a concavely rolled piece 15 arranged such that the convexly rolled pieces 12 and 13 and the concavely rolled pieces 14 and 15 alternate. The edge member 11 has a connecting portion 16 for connecting the pieces 12 and 15, a connecting portion 17 for connecting the pieces 15 and 13, a connecting portion 18 for connecting the pieces 13 and 14 and a connecting portion 19 for connecting the pieces 14 and 12.

Figure 3:
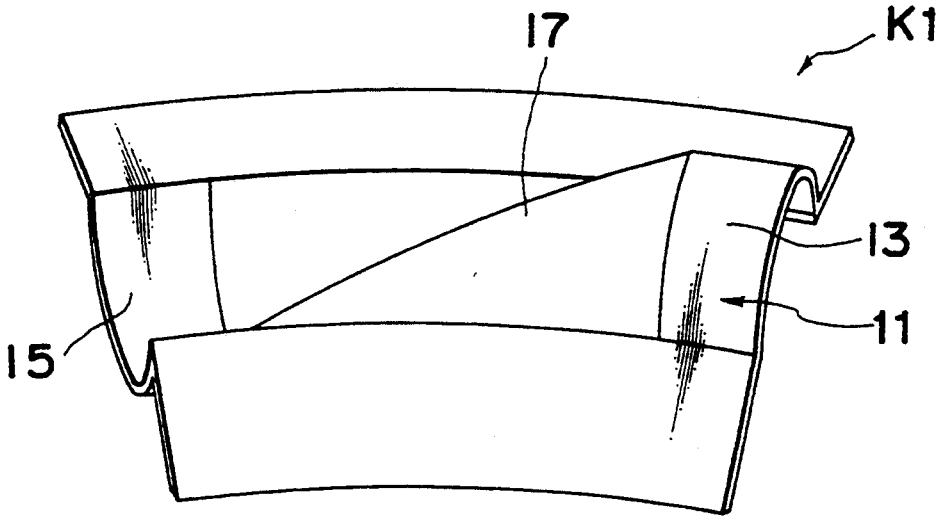
FIG. 3 is an enlarged perspective view of a connecting portion of an edge member in the speaker of FIG. 1.
Figure 8:
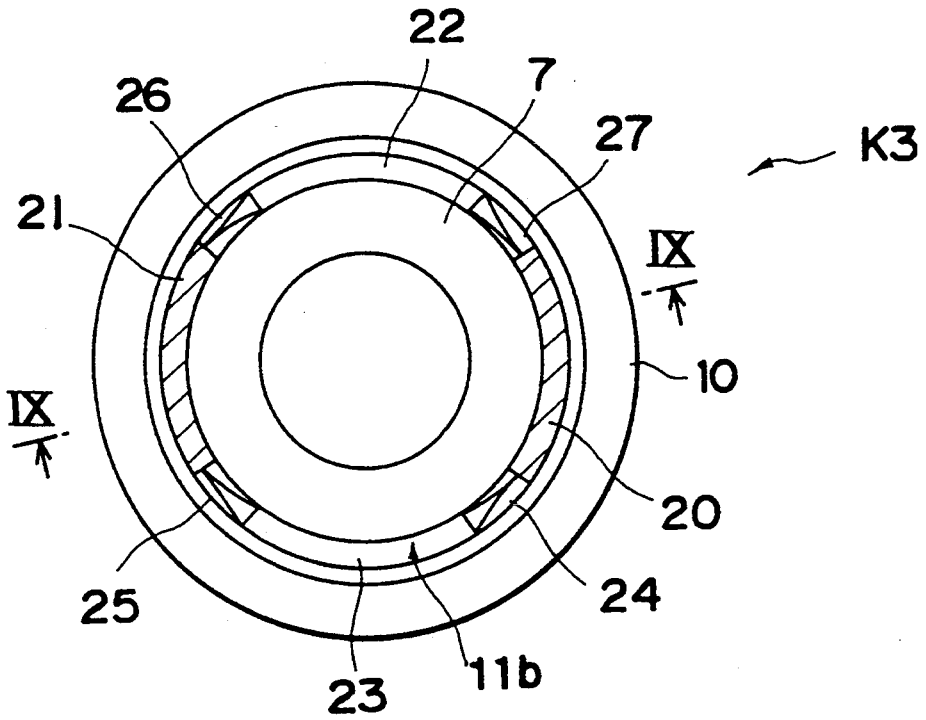
FIG. 8 is a top plan view of a speaker according to a third embodiment of the present invention.
Figure 9:
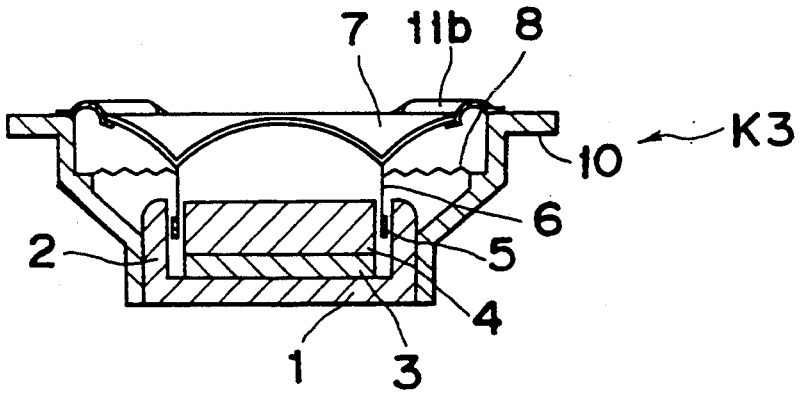
FIG. 9 is a sectional view taken along line IX—IX in FIG. 8.

FIG. 3 shows the connecting portion 17 of the edge member 11. The convexly rolled piece 13 and the concavely rolled piece 15 have cross-sectional shapes symmetric with respect to each other in the vertical direction in FIG. 3, i.e., in the axial direction of the edge member 11, and are connected by the connecting portion 17, whose cross-sectional shape gradually and continuously changes. The connecting portion 17 is constituted by a convexly rolled cross section and a concavely rolled cross section.

The shape of the connecting portion 17 is described in more detail with reference to FIGS. 4 and 5. As shown in FIG. 5, the connecting portion 17 of the speaker K1 has various cross-sectional shapes along the lines A–A' to E–E' of FIG. 4, respectively. As a point on the connecting portion 17 comes closer to the convexly rolled piece 13, the diameter of the convex roll of the connecting portion 17 becomes larger and the diameter of the concave roll of the connecting portion 17 becomes smaller, as shown in FIG. 5. At a location where the connecting portion 17 reaches the convexly rolled piece 13, the diameter of the concave roll of the connecting portion 17 becomes zero, and thus the connecting portion 17 has a cross-sectional shape identical with that of the convexly rolled piece 13. On the contrary, as a point on the connecting portion 17 comes closer to the concavely rolled piece 15, the diameter of the concave roll of the connecting portion 17 becomes larger and the diameter of the convex roll of the connecting portion 17 becomes smaller. At a location where the connecting portion 17 reaches the concavely rolled piece 15, the diameter of the convex roll of the connecting portion 17 becomes zero and thus the connecting portion 17 has a cross-sectional shape identical with that of the concavely rolled piece 15.

Hereinbelow, operation of the speaker K1 of the above described arrangement is described. When an electrical input signal is applied to the voice coil 5, the convexly rolled pieces 12 and 13 and the concavely rolled pieces 14 and 15, which are connected by the connecting portions 16 to 19, act as a support member for the cone-shaped diaphragm 7 without blocking forward and rearward vibrations of the cone-shaped diaphragm 7, and acoustically shield, together with the connecting portions 16 to 19, sound emitted from the back of the cone-shaped diaphragm 7. Initially, when the cone-shaped diaphragm 7 has been vibrated forwardly, the convexly rolled pieces 12 and 13 assume a forward vibration state B of a rolled edge member 9 of a known speaker of FIG. 25, and thus displace a quantity U1 of air. On the other hand, the concavely rolled pieces 14 and 15 assume a forward vibration state which is obtained by forwardly inverting a rearward vibration state C of FIG. 25, and thus displace a quantity U2 of air.

Figure 25:
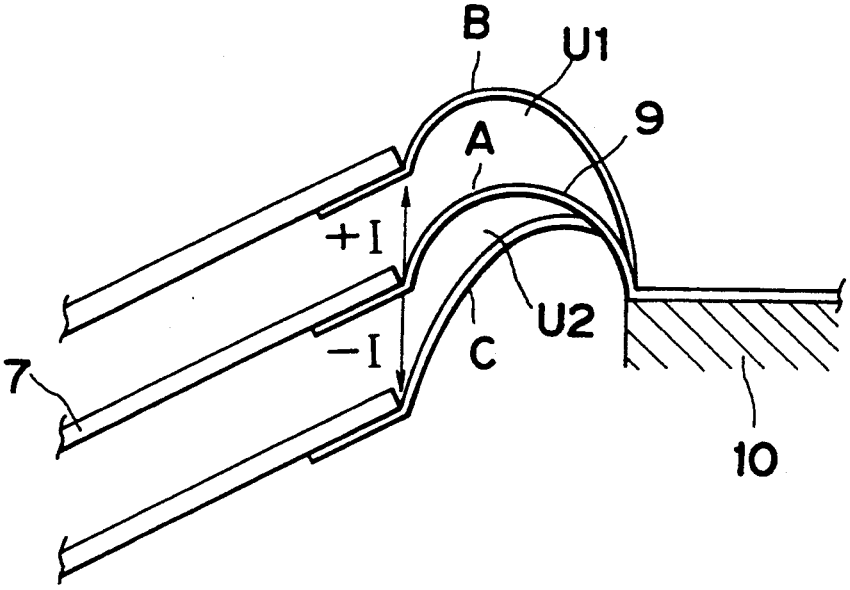
Fig. 25 PRIOR ART
FIG. 25 is a view explanatory of vibration states of an edge member of a prior art speaker (already referred to).

Subsequently, when the cone-shaped diaphragm 7 has been vibrated rearwardly, the convexly rolled pieces 12 and 13 assume the rearward vibration state C of FIG. 25, and thus displace the quantity U2 of air. Meanwhile, the concavely rolled pieces 14 and 15 assume a rearward vibration state which is obtained by rearwardly inverting the forward vibration state B, and thus displace the quantity U1 of air. Namely, in the forward and rearward vibrations of the cone-shaped diaphragm 7, a sum of the quantities of air displaced by the convexly rolled piece 13 and the concavely rolled piece 15 connected by the connecting portion 17 amounts to a predetermined value of (U1+U2) at all times. The same applies to the convexly rolled piece 12 and the concavely rolled piece 15 connected by the connecting portion 16, the convexly rolled piece 13 and the concavely rolled piece 14 connected by the connecting portion 18 and the convexly rolled piece 12 and the concavely rolled piece 14 connected by the connecting portion 19.

The edge member 11 shown in FIGS. 4 and 5 of the speaker K1 may also be modified to an edge member 11*a* of a speaker K2 according to a second embodiment of the present invention as shown in FIGS. 6 and 7. In the edge member 11*a*, the connecting portion 17 of the speaker K1 is replaced by a connecting portion 34, and thus the convexly rolled piece 13 and the concavely rolled piece 15 are connected by the connecting portion 34. As shown in FIG. 7, the connecting portion 34 of the speaker K2 has various cross-sectional shapes along the lines A–A′ to E–E′ of FIG. 6, respectively.

The speakers K1 and K2 include the edge member, the diaphragm secured to the inner periphery of the edge member and the frame attached to the outer periphery of the edge member. The edge member is circumferentially divided into a plurality of the above pieces. Neighboring pieces have cross-sectional shapes symmetric with respect to each other in the axial direction of the edge member, and are connected by the connecting portions whose cross-sectional shapes change gradually and continuously.

Thus, in the speakers K1 and K2, the sum of quantities of air displaced by the neighboring pieces of the edge member in their forward and rearward vibrations is set to the predetermined value at each connecting portion.

Therefore, in accordance with the first and second embodiments of the present invention, secondary harmonic distortion of sound pressure characteristics, which has been caused by a difference between the quantities of air displaced by the edge member in its forward and rearward vibrations in the known speakers, can be reduced greatly, and thus it becomes possible to provide a speaker having low distortion.

FIGS. 8 to 11 show a speaker K3 according to a third embodiment of the present invention. The speaker K3 includes an edge member 11*b*. Since the other features of the speaker K3 are similar to those of the speaker K1, only the edge member 11*b* is described hereinbelow for the sake of brevity. The edge member 11*b* includes convexly rolled pieces 20 and 21 and concavely rolled pieces 22 and 23. In the same manner as in the speaker K1, the convexly rolled pieces 20 and 21 have a cross-sectional shape symmetric with respect to that of the concavely rolled pieces 22 and 23, and are connected with the concavely rolled pieces 22 and 23 by connecting portions 24, 25, 26 and 27, whose cross-sectional shapes change gradually and continuously.

By way of example, only the connecting portion 25 and its neighboring area are described with reference to FIGS. 10 and 11. In FIG. 10, the convexly rolled piece 21 and the concavely rolled piece 23 are connected by the connecting portion 25. As shown in FIG. 11, the connecting portion 25 of the speaker K3 has various cross-sectional shapes along the lines A–A′ to E–E′ of FIG. 10, respectively. As is apparent from FIGS. 10 and 11(*d*), the cross-sectional shape of the connecting portion 25 is constituted by opposite convex rolls and one central concave roll interposed between the convex rolls in the radial direction of the edge member 11*b*. As shown in FIG. 11, as a point on the connecting portion 25 comes closer to the convexly rolled piece 21, the diameters of the convex rolls of the connecting portion 25 becomes larger and the diameter of the concave roll of the connecting portion 25 becomes smaller. At a location where the connecting portion 25 reaches the convexly rolled piece 21, the diameter of the concave roll of the connecting portion 25 becomes zero, and thus, the connecting portion 25 has a cross-sectional shape identical with that of the convexly rolled piece 21.

On the other hand, as a point on the connecting portion 25 comes closer to the concavely rolled piece 23, the diameter of the concave roll of the connecting portion 25 becomes larger and the diameters of the convex rolls of the connecting portion become smaller. At a location where the connecting portion 25 reaches the concavely rolled piece 23, the diameters of the convex rolls becomes zero, and thus the connecting portion 25 has a cross-sectional shape identical with that of the convexly rolled piece 23.

Since the operation and effects of the speaker K3 are the same as those of the speaker K1, a description thereof is abbreviated.

The edge member 11*b* shown in FIGS. 10 and 11 of the speaker K3 may also be modified to an edge member 11*c* of a speaker K4 according to a fourth embodiment of the present invention as shown in FIGS. 12 and 13. In the edge member 11*c*, the connecting portion 25 of the speaker K3 is replaced by a connecting portion 35, and thus the convexly rolled piece 21 and the concavely rolled piece 23 are connected by the connecting portion 35. As shown in FIG. 13, the connecting portion 35 of the speaker K4 has various cross-sectional shapes along the lines A–A′ to E–E′ of FIG. 12, respectively. As will be seen from FIGS. 12 and 13(*c*), the cross-sectional shape of the connecting portion 35 is constituted by opposite concave rolls and one central convex roll interposed between the concave rolls in the radial direction of the edge member 11*c*.

The speakers K1 to K4 have four connecting portions. However, in the speakers K1 to K4, it can also be so arranged that any arbitrary even number (>2) of connecting portions are provided, such that a sum of the quantities displaced by one convexly rolled piece and its adjacent concavely rolled piece connected by each connecting portion are set to the predetermined value in the forward and rearward vibrations of the cone-shaped diaphragm. As a result, the same effects of the speakers K1 to K4 can be obtained.

Furthermore, based on this technical idea, a speaker K5 according to a fifth embodiment of the present invention includes an edge member 11*d* as shown in FIGS. 14 and 15, while a speaker K6 according to a sixth embodiment of the present invention includes an edge member 11*e* as shown in FIGS. 16 and 17. Each of the edge members 11*d* and 11*e* is constituted by only a plurality of convexly rolled and concavely rolled connecting portions arranged circumferentially and alternately. As shown in FIG. 15, the connecting portions of the speaker K5 have various cross-sectional shapes along the lines A–A' to E–E' in FIG. 14, respectively. Meanwhile, as shown in FIG. 17, the connecting portions of the speaker K6 have various cross-sectional shapes along the lines A–A' to E–E' in FIG. 16, respectively. Thus, the edge member 11*d* includes convexly rolled connecting portions 28 to 30 and concavely rolled connecting portions 31 to 33, while the edge member 11*e* includes convexly rolled connecting portions 36 to 38 and concavely rolled connecting portions 39 to 41. Meanwhile, the connecting portions of the edge member 11*d* of the speaker K5 may also be combined with those of the edge member 11*e* of the speaker K6.

Furthermore, the edge member may also be formed by properly combining the connecting portions of the speakers K1 and K2. In addition, the edge member may also be formed by properly combining the connecting portions of the speakers K3 and K4.

Meanwhile, in the speakers K1 to K6, the maximum width of the roll of the connecting portions is not necessarily required to be equal to the width of the edge member, due to the employment of an arrangement in which a flat portion is provided at one or opposite radial ends of the roll of the connecting portions.

Figure 18:
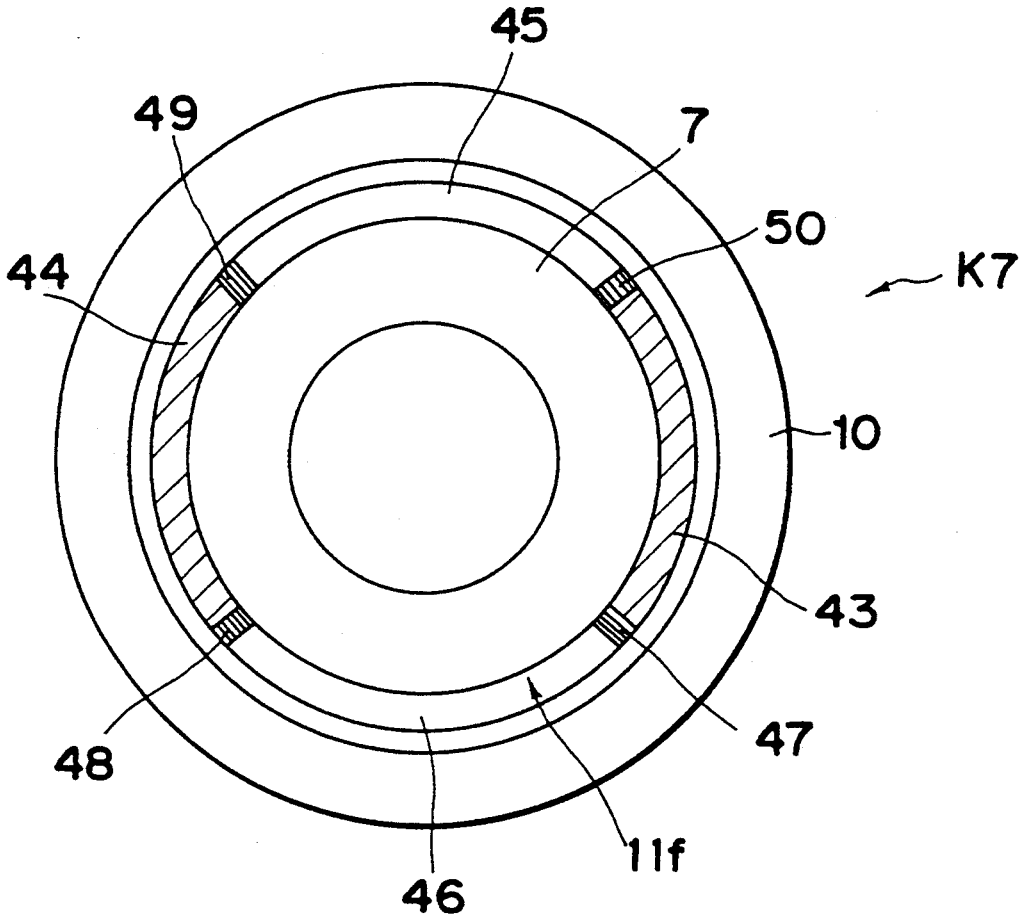
FIG. 18 is a top plan view of a speaker according to a seventh embodiment of the present invention.
Figure 19:
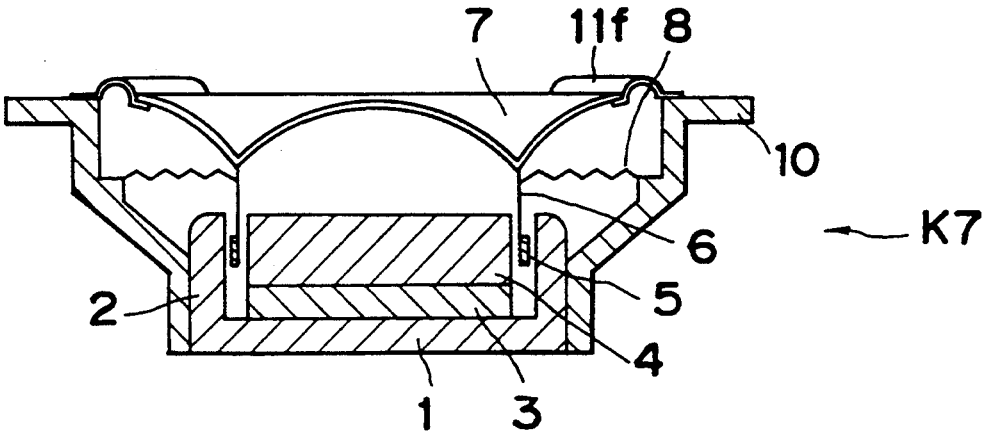
FIG. 19 is a sectional view of the speaker of FIG. 18.
Figure 20:
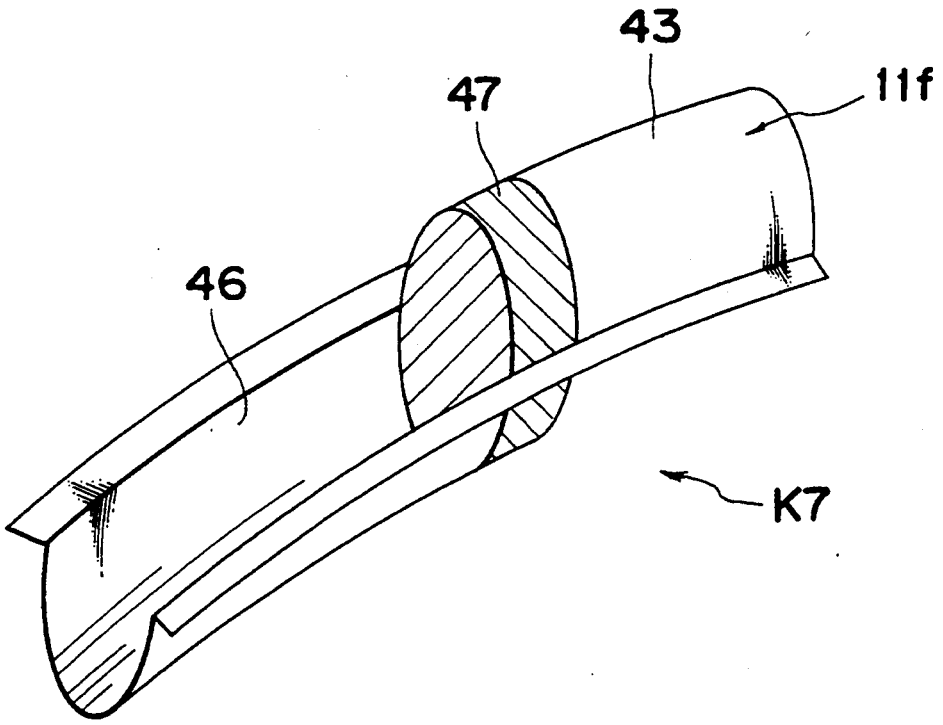
FIG. 20 is a perspective view of a connecting portion of an edge member in the speaker of FIG. 18.

FIGS. 18 to 20 show a speaker K7 according to a seventh embodiment of the present invention. The speaker K7 includes an edge member 11*f*. Since the other features of the speaker K7 are similar to those of the speaker K1, only the edge member 11*f* is described hereinbelow for the sake of brevity. The edge member 11*f* includes convexly rolled pieces 43 and 44, concavely rolled pieces 45 and 46 and cylindrical air shields 47, 48, 49 and 50 made of foamed material. The convexly rolled pieces 43 and 44 are connected with the concavely rolled pieces 45 and 46 by the air shields 47 to 50. As shown in FIG. 20, the convexly rolled piece 43 and the concavely rolled piece 46 have cross-sectional shapes symmetric with respect to each other in the axial direction of the edge member 11*f* and are connected with each other by the air shield 47.

Operation of the speaker K7 of the above described arrangement is described hereinbelow. When an electrical input is applied to the voice coil 5 based on the supposition that the air shields 47 to 50 are made of, for example, a flexible material such as urethane rubber, the convexly rolled pieces 43 and 44 and the concavely rolled pieces 45 and 46 act as a support member for the cone-shaped diaphragm 7 without blocking forward and rearward vibrations of the cone-shaped diaphragm 7, while the air shields 47 to 50 acoustically shield sound emitted from the back of the cone-shaped diaphragm 7. Therefore, in forward and rearward vibrations of the cone-shaped diaphragm 7, the sum of the quantities of air displaced by the convexly rolled piece 43 and the concavely rolled piece 46 connected by the connecting portion 47 is set to the predetermined value of (U1+U2) in the same manner as in the speaker K1.

Figure 21:
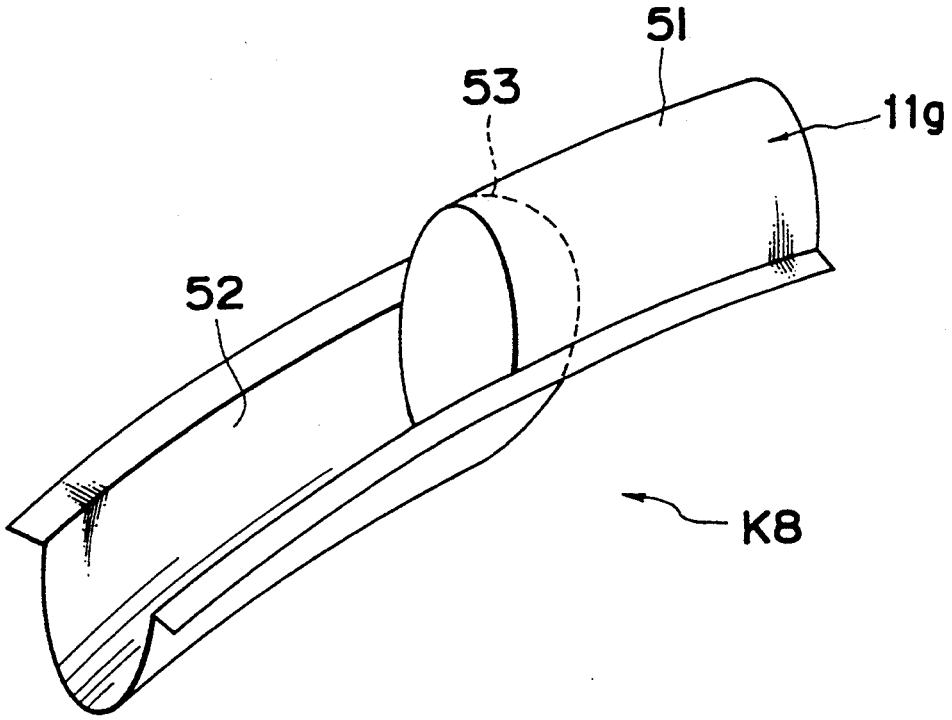
FIG. 21 is a perspective view of a connecting portion of an edge member in a speaker according to an eighth embodiment of the present invention.

FIG. 21 shows an edge member 11*g* of a speaker K8 according to an eighth embodiment of the present invention. In FIG. 21, a convexly rolled piece 51 and a concavely rolled piece 52 are connected with each other by an air shield 53. The air shield 53 is formed by a hollow hemispherical film. Since the other features of the speaker K8 are similar to those of the speaker K7, the description thereof is not repeated.

Figure 22:
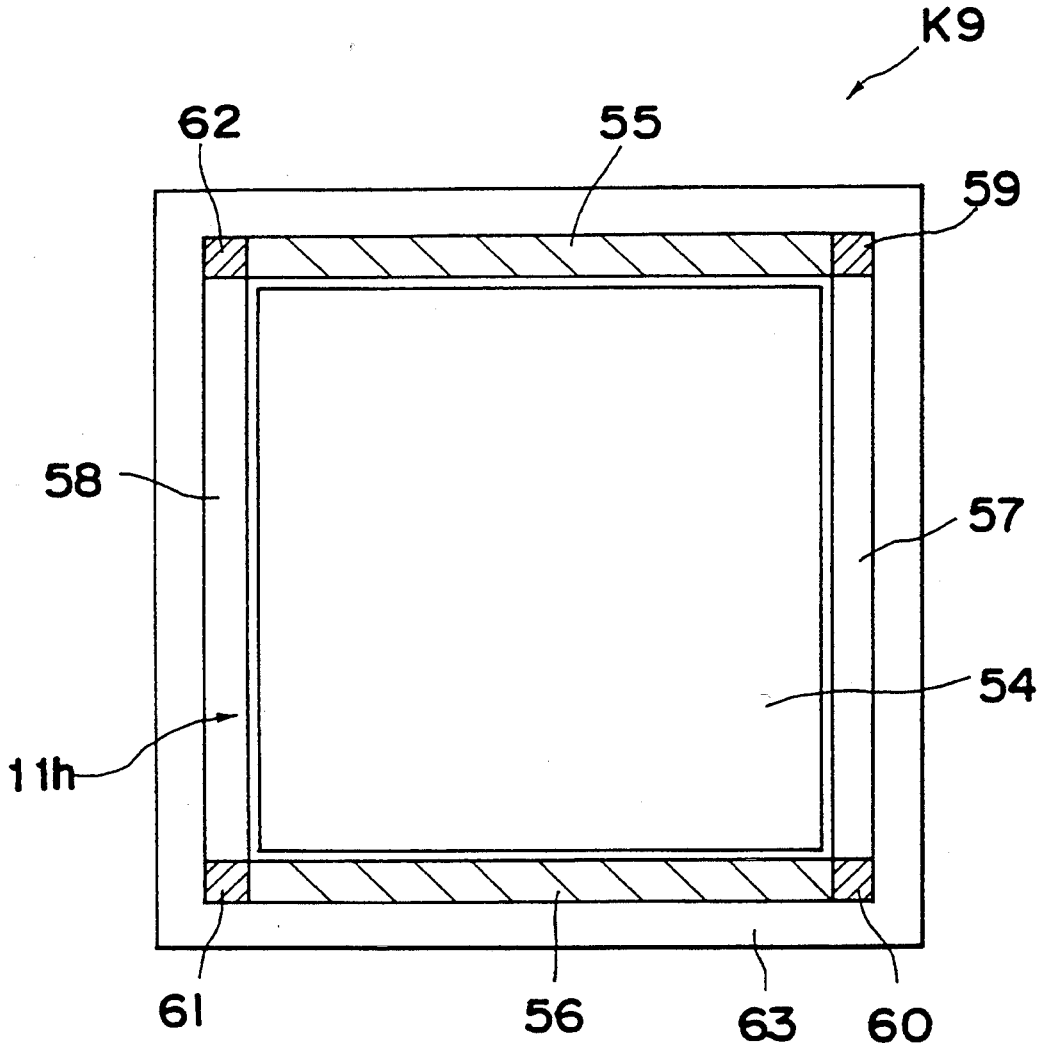
FIG. 22 is a top plan view of a speaker according to a ninth embodiment of the present invention.

FIG. 22 shows a speaker K9 according to a ninth embodiment of the present invention. The speaker K9 includes a square diaphragm 54, a square edge member 11*h* having a square opening surrounding the diaphragm 54 and a frame 63. The square edge member 11*h* includes a pair of opposed convexly rolled pieces 55 and 56, another pair of opposed concavely rolled pieces 57 and 58 and air shields 59, 60, 61 and 62 made of a foamed material. The air shields 59 to 62 are, respectively, provided at the four corners of the square edge member 11*h* so as to connect the concavely rolled pieces 55 and 56 with the concavely rolled pieces 57 and 58. Therefore, the edge member 11*h* acts as a support member for the diaphragm 54 without blocking forward and rearward vibrations of the diaphragm 54. For forward and rearward vibrations of the diaphragm 54, the sum of quantities of air displaced by, for example, the convexly rolled piece 55 and the concavely rolled piece 57, connected by the connecting portion 59, is set to the predetermined value of (U1+U2) in the same manner as in the speaker K1.

Meanwhile, in the speaker K9, the connecting portions 59 to 62 are made of a foamed material. However, even if the connecting portions 59 to 62 are replaced by those of the speakers K1 to K4, the same effects can be achieved.

Furthermore, in the speaker K9, the connecting portions 59 to 62 are provided at the corners of the edge member 11*h*, but they also be provided at a central portion of each of the side portions of the edge member 11*h*.

Figure 23:
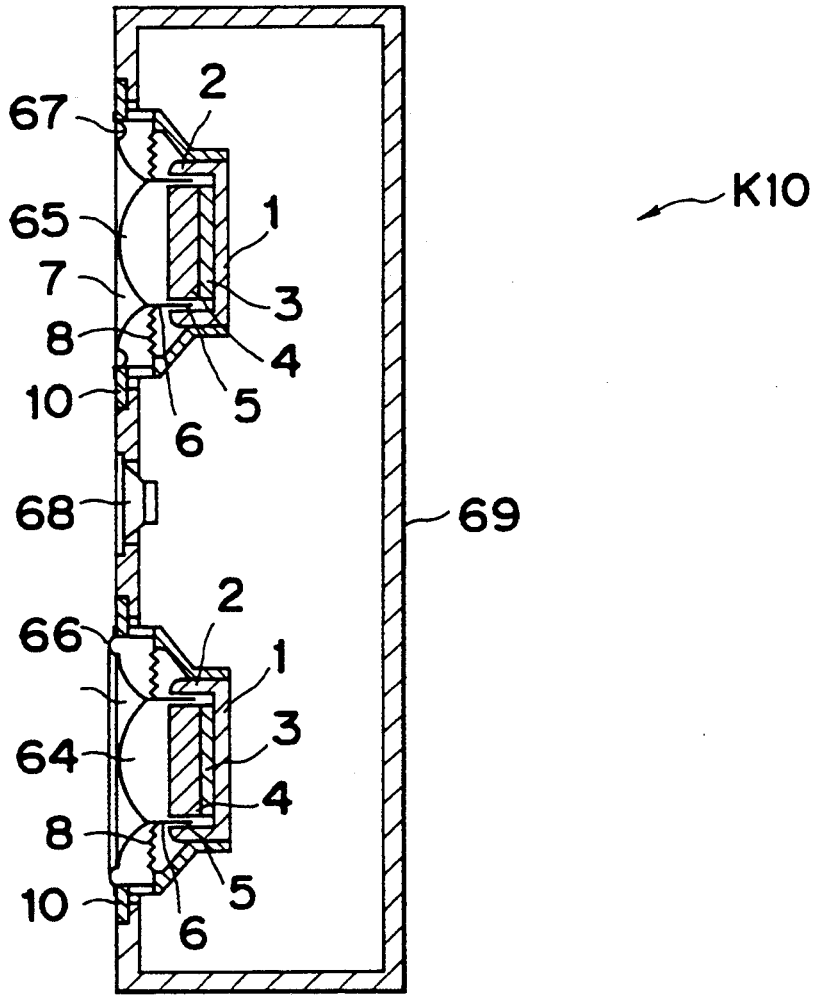
FIG. 23 is a sectional view of a speaker system according to a tenth embodiment of the present invention.

Hereinbelow, a speaker system K10 according to a tenth embodiment of the present invention is described with reference to FIG. 23. The speaker system K10 includes first and second speaker units 64 and 65, a speaker unit 68 for sound of an intermediate and high pitch, and a cabinet 69 on which the first and second speaker units 64 and 65 and the speaker 68 are mounted. The first speaker unit 64 is provided with a convexly rolled edge member 66, while the second speaker unit 65 is provided with a concavely rolled edge member 67. The first and second speaker units 64 and 65 are provided at respective opposite end portions of the cabinet 69, while the speaker 68 is disposed at a substantially central portion of the cabinet 69 so as to be interposed between the first and second speaker units 64 and 65. Since the other features of the first and second speaker units 64 and 65 are similar to those of the speaker K1, the description thereof is abbreviated.

The speaker system K10 of the above described arrangement is operated as follows. When the cone-shaped diaphragm 7 of each of the first and second speaker units 64 and 65 has been vibrated forwardly upon application of an identical electrical signal to the voice coil 5 of each of the first and second speaker units 64 and 65, the convexly rolled edge member 66 of the first speaker unit 64 assumes the forward vibration state B of the rolled edge member 9 of the known speaker of FIG. 25, and thus displaces the quantity U1 of air. On the other hand, the concavely rolled edge member 67 of the second speaker unit 65 assumes a forward vibration state, which is obtained by forwardly inverting the rearward vibration state C of FIG. 25, and thus displaces the quantity U2 of air.

Subsequently, when the cone-shaped diaphragm 7 has been vibrated rearwardly, the convexly rolled edge member 66 of the first speaker unit 64 assume the rearward vibration state C of FIG. 25, and thus displaces the quantity U2 of air. Meanwhile, the concavely rolled edge member 67 of the second speaker unit 65 assume a rearward vibration state, which is obtained by rearwardly inverting the forward vibration state B, and thus displaces the quantity U1 of air. Namely, in forward and rearward vibrations of the cone-shaped diaphragm 7, the sum of the quantities of air displaced by the convexly rolled edge member 66 of the first speaker unit 64 and the concavely rolled edge member 67 of the second speaker unit 65 is set to the predetermined value of (U1+U2) at all times.

Figure 24:
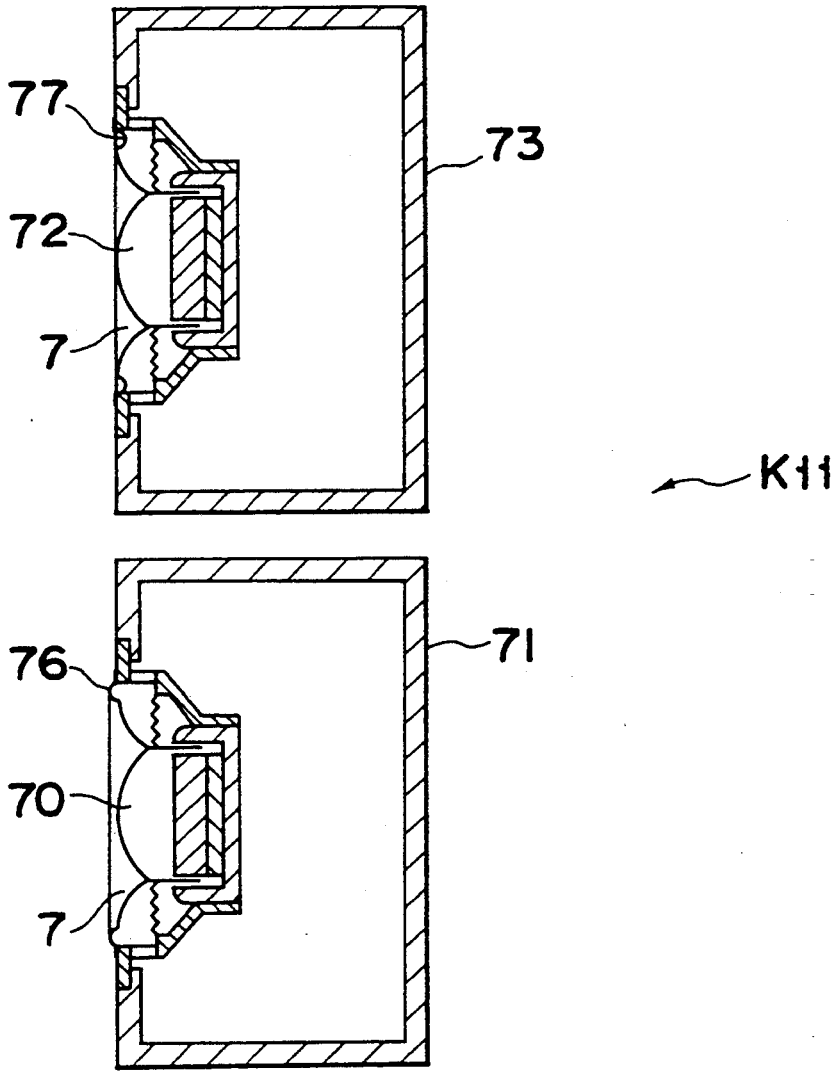
FIG. 24 is a sectional view of a speaker system according to an eleventh embodiment of the present invention.

Finally, a speaker system K11 according to an eleventh embodiment of the present invention is described with reference to FIG. 24. The speaker system K11 includes a first speaker unit 70 mounted on a first cabinet 71 and a second speaker unit 72 mounted on a second cabinet 73. The first speaker unit 70 is provided with a convexly rolled edge member 76, while the second speaker unit 72 is provided with a concavely rolled edge member 77. The speaker system K11 is different from the speaker system K10 in that the first and second speaker units 64 and 65 of the speaker system K10 are integrally provided in the cabinet 69, while the first and second speaker units 70 and 72 of the speaker system K11 are separately provided in the first and second cabinets 71 and 73, respectively. Since the other features of the speaker system K11 are similar to those of the speaker system K10, the description thereof is abbreviated.

When an electrical signal is applied to the first and second speaker units 70 and 72, the speaker system K11 is operated in the same manner as in the speaker system K10. Therefore, in forward and rearward vibrations of the cone-shaped diaphragm 7, the sum of the quantities of air displaced by the convexly rolled edge member 76 of the first speaker unit 70 and the concavely rolled edge member 77 of the second speaker unit 72 is set to the predetermined value of (U1+U2) at all times.

In the speaker system K11, since the first and second cabinets 71 and 73 are provided separately from each other, the degree of freedom in the layout of the system can be increased. Although not specifically shown, the speaker system K11 may also be provided with a speaker system for sound of an intermediate and high pitch, such that the first and second speaker units 70 and 72 are used for sound of a low pitch.

Meanwhile, in the speaker systems K10 and K11, two speaker units are employed. However, any arbitrary even number of, e.g., four or six speaker units may also be employed, such that the sum of the quantities of air displaced by the convexly rolled edge members and the concavely rolled edge members is set to a predetermined value.

What is claimed is:

1. A speaker system comprising:

an edge member comprising a plurality of peripheral pieces and a plurality of connecting portions connecting neighboring ones of said pieces;

said neighboring ones of said pieces having cross-sectional shapes symmetric with respect to each other and each of said connecting portions having a cross-sectional shape changing gradually and continuously;

a diaphragm secured to one of an inner periphery and an outer periphery of said edge member; and a frame secured to the other of the inner periphery and the outer periphery of said edge member;

wherein said pieces include a convexly rolled piece and a concavely rolled piece, and the cross-sectional shape of each of said connecting portions comprises one convex roll and one concave roll;

wherein as a point on each of said connecting portions comes closer to said convexly rolled piece, the diameter of said convex roll of each of said connecting portions becomes larger and the diameter of said concave roll of each of said connecting portions becomes smaller and assumes, at a location where each of said connecting portions reaches said convexly rolled piece, a zero value such that said cross-sectional shape of each of said connecting portions becomes identical with that of said convexly rolled piece; and wherein as a point on each of said connecting portions comes closer to said concavely rolled piece, the diameter of said concave roll of each of said connecting portions becomes larger and the diameter of said convex roll of each of said connecting portions becomes smaller and assumes, at a location where each of said connecting portions reaches said concavely rolled piece, a zero value such that said cross-sectional shape of each of said connecting portions becomes identical with that of said concavely rolled piece.

2. A speaker system comprising:

an edge member comprising a plurality of peripheral pieces and a plurality of connecting portions connecting neighboring ones of said pieces:

said neighboring ones of said pieces having cross-sectional shapes symmetric with respect to each other and each of said connecting portions having a cross-sectional shape changing gradually and continuously;

a diaphragm secured to one of an inner periphery and an outer periphery of said edge member; and a frame secured to the other of the inner periphery and the outer periphery of said edge member;

wherein said pieces include a convexly rolled piece and a concavely rolled piece, and the cross-sectional shape of each of said connecting portions comprises two convex rolls and one concave roll;

wherein as a point on each of said connecting portions comes closer to said convexly rolled piece, the diameters of said convex rolls of each of said connecting portions become larger and the diameter of said concave roll of each of said connecting portions becomes smaller and assumes, at a location where each of said connecting portions reaches said convexly rolled piece, a zero value such that said cross-sectional shape of each of said connecting portions becomes identical with that of said convexly rolled piece; and wherein as a point on each of said connecting portions comes closer to said concavely rolled piece, the diameter of said concave roll of each of said connecting portions becomes larger, while the diameters of said convex rolls of each of said connecting portions becomes smaller and assume, at a location where each of said connecting portions reaches said concavely rolled piece, a zero value such that said cross-sectional shape of each of said connecting portions becomes identical with that of said concavely rolled piece.

3. A speaker system comprising:

an edge member comprising a plurality of peripheral pieces and a plurality of connecting portions connecting neighboring ones of said pieces;

said neighboring ones of said pieces having cross-sectional shapes symmetric with respect to each other and each of said connecting portions having a cross-sectional shape changing gradually and continuously;

a diaphragm secured to one of an inner periphery and an outer periphery of said edge member; and a frame secured to the other of the inner periphery and the outer periphery of said edge member;

wherein said pieces include a convexly rolled piece and a concavely rolled piece, and the cross-sectional shape of each of said connecting portions comprises one convex roll and two concave rolls;

wherein as a point on each of said connecting portions comes closer to said convexly rolled piece, the diameter of said convex roll of each of said connecting portions becomes larger and the diameters of said concave rolls of each of said connecting portions become smaller and assume, at a location where each of said connecting portions reaches said convexly rolled piece, a zero value such that said cross-sectional shape of each of said connecting portions becomes identical with that of said convexly rolled piece; and wherein as a point on each of said connecting portions comes closer to said concavely rolled piece, the diameters of said concave rolls of each of said connecting portions become larger and the diameter of said convex roll of each of said connecting portions becomes smaller and assumes, at a location where each of said connecting portions reaches said concavely rolled piece, a zero value such that said cross-sectional shape of each of said connecting portions becomes identical with that of said concavely rolled piece.

4. A speaker assembly, comprising:

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of convexly rolled portions, a plurality of concavely rolled portions alternating with said convexly rolled portions, and connecting portions connecting ends of adjacent said convexly and concavely rolled portions, the adjacent said convexly and concavely rolled portions on respective sides of a said connecting portion having cross-sectional shapes symmetric with respect to each other, and each of said connecting portions having a cross sectional shape that changes from convex at one end to concave at its other end.

5. The speaker assembly of claim 4, wherein said edge member forms a loop and said convexly and concavely rolled portions alternate circumferentially.

6. A speaker assembly comprising:

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of convexly rolled portions, a plurality of concavely rolled portions alternating with said convexly rolled portions, and connecting portions connecting ends of adjacent said convexly and concavely rolled portions, the adjacent said convexly and concavely rolled portions on respective sides of a said connecting portion having cross-sectional shapes symmetric with respect to each other, and each of said connecting portions having a cross sectional shape that changes between the ends of the respective adjacent said convexly and concavely rolled portions on said respective sides of each of said connecting portions; and wherein each of said connecting portions has one end located at and having the same cross sectional shape as the adjacent said convexly rolled portion, and another end located at and having the same cross sectional shape as the adjacent said concavely rolled portion such that said edge member changes cross sectional shape between said convexly and concavely rolled portions continuously at said connecting portions.

7. A speaker assembly, comprising:

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of convexly rolled portions, a plurality of concavely rolled portions alternating with said convexly rolled portions, and connecting portions connecting ends of adjacent said convexly and concavely rolled portions, the adjacent said convexly and concavely rolled portions on respective sides of a said connecting portion having cross-sectional shapes symmetric with respect to each other, and each of said connecting portions having a cross sectional shape that changes between the ends of the respective adjacent said convexly and concavely rolled portions on said respective sides of each of said connecting portions; and said cross sectional shape has been inserted comprising one convex roll and one concave roll;

as each of said connecting portions approaches the adjacent said convexly rolled portion, the diameter of said convex roll of said connecting portion increases while the diameter of said concave roll decreases and becomes zero at the point where said connecting portion reaches said convexly rolled portion such that the cross sectional shape of said connecting portion becomes the same as said convexly rolled portion; and as each of said connecting portions approaches the adjacent said concavely rolled portion, the diameter of said concave roll of said connecting portion increases, while the diameter of said convex roll decreases and becomes zero at the point where said connecting portion reaches said concavely rolled portion such that the cross sectional shape of said connecting portion becomes the same as said concavely rolled portion.

8. A speaker assembly, comprising.

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of convexly rolled portions, a plurality of concavely rolled portions alternating with said convexly rolled portions, and connecting portions connecting ends of adjacent said convexly and concavely rolled portions, the adjacent said convexly and concavely rolled portions on respective sides of a said connecting portion having cross-sectional shapes symmetric with respect to each other, and each of said connecting portions having a cross sectional shape that changes between the ends of the respective adjacent said convexly and concavely rolled portions on said respective sides of each of said connecting portions;

wherein said cross sectional shape has been inserted comprising two convex rolls and one concave roll;

wherein as each of said connecting portions approaches the adjacent said convexly rolled portion, the diameters of the convex rolls of said connecting portion increases, while the diameter of said concave roll of each said connecting portion decreases and becomes zero at the point where said connecting portion reaches said convexly rolled portion such that the cross sectional shape of said connecting portion becomes the same as said convexly rolled portion; and wherein as each of said connecting portions approaches the adjacent said concavely rolled portion, the diameter of said concave roll of said connecting portion increases, while the diameters of said convex rolls of each said connecting portion decrease and become zero at the point where said connecting portion reaches said concavely rolled portion such that the cross sectional shape of said connecting portion becomes the same as said concavely rolled portion.

9. A speaker assembly, comprising:

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of convexly rolled portions, a plurality of concavely rolled portions alternating with said convexly rolled portions, and connecting portions connecting ends of adjacent said convexly and concavely rolled portions, the adjacent said convexly and concavely rolled portions on respective sides of a said connecting portion having cross-sectional shapes symmetric with respect to each other, and each of said connecting portions having a cross sectional shape that changes between the ends of the respective adjacent said convexly and concavely rolled portions on said respective sides of each of said connecting portions;

wherein said cross sectional shape has been inserted comprising one convex roll and two concave rolls;

wherein as each of said connecting portions approaches the adjacent said convexly rolled portion, the diameter of said convex roll of said connecting portion increases while the diameters of said concave rolls of each said connecting portion decrease and become zero at the point where said connecting portion reaches said convexly rolled portion such that the cross sectional shape of said connecting portion becomes the same as said convexly rolled portion; and wherein as each of said connecting portions approaches the adjacent said concavely rolled portion, the diameters of said concave rolls of each said connecting portion increase, while the diameter of said convex roll decreases and becomes zero at the point where said connecting portion reaches said concavely rolled portion such that the cross sectional shape of said connecting portion becomes the same as said concavely rolled portion.

10. A speaker assembly, comprising::

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of connecting portions, each said connecting portion comprises a convex roll and a concave roll, each said connecting portion connects with adjacent said connecting portions such that one of said convex roll and said concave roll of each said connecting portion confronts the corresponding ones of said convex roll and concave rolls of the adjacent said connecting portions such that the cross sectional shape of each of said connecting portions changes from convex at one end to concave at its other end; and wherein said edge member has the property of, when said diaphragm is vibrated in forward and rearward directions, displacing air with said convex rolls and said concave rolls of said connecting portions such that the sum of the quantity of air displaced by said convex and concave rolls when vibrating in the forward direction is a predetermined value equal to the sum of the quantity of air displaced by said convex and concave rolls when vibrating in the rearward direction.

11. A speaker assembly, comprising:

an edge member having an inner periphery and an outer periphery;

a diaphragm secured to one of said inner periphery and said outer periphery of said edge member; and a frame secured to the other of said inner periphery and said outer periphery of said edge member;

wherein said edge member comprises a plurality of convexly rolled portions, a plurality of concavely rolled portions alternating with said convexly rolled portions along said edge member, and a plurality of air shields circumferentially connecting adjacent said convexly and concavely rolled portions, and wherein the adjacent said convexly and concavely rolled portions on respective sides of said air shields have cross sectional shapes symmetric with respect to each other;

wherein said diaphragm has a square shape, said edge member has a square shape, and said edge member comprises two said convexly rolled portions disposed along a first pair of opposite sides of the square shape of said edge member and two said concavely rolled portions disposed along a second pair of opposite sides of said square shape.

* * * * *